US011230431B2

(12) United States Patent
Calsina Gomis

(10) Patent No.: US 11,230,431 B2
(45) Date of Patent: Jan. 25, 2022

(54) CAPSULE FOR PREPARING INFUSION BEVERAGES

(71) Applicant: PRODUCTOS SOLUBLES S.A., Palencia (ES)

(72) Inventor: Joaquin Calsina Gomis, Barcelona (ES)

(73) Assignee: PRODUCTOS SOLUBLES S.A., Palencia (ES)

( * ) Notice: Subject to any disclaimer, the term of this patent is extended or adjusted under 35 U.S.C. 154(b) by 77 days.

(21) Appl. No.: 16/649,782

(22) PCT Filed: Sep. 20, 2018

(86) PCT No.: PCT/EP2018/075502
§ 371 (c)(1),
(2) Date: Mar. 23, 2020

(87) PCT Pub. No.: WO2019/057831
PCT Pub. Date: Mar. 28, 2019

(65) Prior Publication Data

US 2020/0307901 A1 Oct. 1, 2020

(30) Foreign Application Priority Data

Sep. 21, 2017 (EP) ..... 17192473

(51) Int. Cl.
*B65D 85/804* (2006.01)

(52) U.S. Cl.
CPC ..... *B65D 85/8052* (2020.05); *B65D 85/8043* (2013.01); *B65D 85/8061* (2020.05)

(58) Field of Classification Search
CPC ..... B65D 85/9043; B65D 85/8049; B65D 85/8052
See application file for complete search history.

(56) References Cited

FOREIGN PATENT DOCUMENTS

EP 2906486 A1 8/2015
WO WO 2013/124234 A1 8/2013
(Continued)

OTHER PUBLICATIONS

Form PCT/ISA/210; International Search Report dated Nov. 15, 2018 in corresponding International Patent Application No. PCT/EP2018/075502 (3 pages).

*Primary Examiner* — Viren A Thakur
*Assistant Examiner* — Chaim A Smith
(74) *Attorney, Agent, or Firm* — Staas & Halsey, LLP

(57) ABSTRACT

A capsule for preparing infusion beverages, includes a containing body and a cover forming an inner chamber for containing an infusion product. An end wall of the containing body includes a deformation section and a central section arranged inside the deformation section such that the capsule can be moved between a closed position, in which the central section is remote from the inner chamber, and an open position, in which the central section is close to the inner chamber. The capsule further includes a sheet-like closing layer arranged adjacent to the end wall for closing the inner chamber and an inner wall adjacent to the sheet-like closing layer. Also perforation members are provided such that when the capsule is in the open position, the sheet-like closing layer is perforated by the perforation members against the end wall or the inner wall.

10 Claims, 4 Drawing Sheets

(56) References Cited

FOREIGN PATENT DOCUMENTS

| | | | | |
|---|---|---|---|---|
| WO | WO 2016/102736 | A2 | 6/2016 | |
| WO | WO 2017/109718 | A1 | 6/2017 | |
| WO | WO-2017145091 | A1 * | 8/2017 | ..... B65D 85/8043 |

* cited by examiner

CAPSULE FOR PREPARING INFUSION BEVERAGES

CROSS-REFERENCE TO RELATED APPLICATIONS

This application is filed under 35 U.S.C. § 371 as a PCT national phase of PCT International Application No. PCT/EP2018/075502, filed on Sep. 20, 2018, in the European Patent Office, which claims the priority benefit of European Patent Application No. 1719247.3, filed on Sep. 21, 2017, in the European Patent Office. The contents of the PCT International Application No. PCT/EP2018/075502 and the European Patent Application No. 1719247.3 are incorporated by reference herein.

FIELD OF THE INVENTION

The invention relates to a capsule for preparing infusion beverages comprising a containing body with a side wall and an end wall, said containing body defining a longitudinal direction and a cover, said containing body and said cover being connected to each other at said side wall to form an inner chamber for containing an infusion product, said end wall having a central section, an outer section arranged around said central section, and a deformation section connecting said central and said outer sections such that said central and said outer sections are movable relative to each other via said deformation section for moving said capsule between: a closed position, in which said central section is remote from said inner chamber and an open position, in which said central section is near to said inner chamber, and a first opening for extracting said infusion beverage, said capsule further comprising a sheet-like closing layer arranged adjacent to said end wall for closing said inner chamber from said first opening for extraction, said closing layer having a bearing side and a perforation side, and perforation members, arranged in said inner chamber adjacent to said perforation side of said closing layer to perforate said closing layer when said capsule is in said open position.

In the invention, the open position is meant to be a final position causing the opening of the capsule such that the infusion beverage can be extracted.

STATE OF THE ART

Single or multiple dose capsules for preparing infusions are becoming more and more popular in the recent years.

Known capsules in the art contain an infusion product such as coffee, brew, tea, juice or the like, in a closed inner chamber. For preparing the infusion beverage, the infusion product needs to be mixed normally with water, either hot or cold, or some similar edible fluid, by introducing the fluid into the closed inner chamber and extracting the infusion beverage through an extraction opening.

In order to provide a high quality product and preserve the properties of the infusion product, these capsules are preferably sealed either by using air-tight materials of the capsule or by enveloping the capsule in an air-tight envelope. This sealing avoids fast oxidation of the infusion product by the contact with air.

A known system of operation of these capsules is to open the capsule mechanically with the help of the capsule holder of the machine with which the infusion is to be prepared, before starting the introduction of the infusion fluid into the inner chamber. Alternatively, the capsule can be introduced into the capsule holder in a closed stated, and be punctured to introduce the infusion fluid. Then, the capsule opens at the extraction side thereof due to the raise of the hydrostatic pressure in the inner chamber. This second solution has the problem that, sometimes, the capsule does not open properly and water comes off without the capsule being opened at the extraction side.

The invention refers to the first type of opening of the capsule.

Document EP 2906486 B1 discloses a capsule for preparing beverages, in particular coffee. The capsule comprises a containing body having a first section and a second section defining an inner volume adapted to contain a substance for preparing the beverage. The second section has a perimeter edge, a central section and a crown section. The crown section is arranged between the perimeter edge and the central section via a first bending line and a second bending line. The crown section and the central section are provided with a plurality of breaking means. Furthermore, the capsule comprises an inner covering layer arranged between the second section and the inner volume of the containing body. The covering layer is connected only to the perimeter edge of the capsule. The second section is collapsible towards the inside of the containing body under the action of a pressing force to create one or more flow passageways in the covering layer via the breaking means. The passageways in the covering layer provides for the fluid connection of the inner volume with the outside of the capsule for extracting the beverage. When the second section collapses, sometimes the breaking means do not break the covering layer, but simply deform its surface at the breaking means side. If the capsule does not open properly, it can happen that it suddenly opens due to the pressure raise within the inner volume and thus that the outcoming infusion beverage splashes in the user's cup. Alternatively, if the deformation is not large enough it can cause the water to come off the containing body, instead of at the extraction side of the capsule and spreads all over in the capsule holder, not allowing the beverage to be prepared, and thereby wetting the inside of the machine.

Alternatively, document EP 3118139 A1 discloses a capsule comprising a capsule body with a side wall and a bottom, and a lid covering the capsule body for containing an infusion product. The bottom is divided into one outer bottom section and one inner bottom section in relation to the longitudinal central axis of the capsule. The outer bottom section and the inner bottom section are movably connected to one another via a connecting section, in the direction of the longitudinal central axis. An impermeable membrane, which is connected to the outer bottom section, is arranged above the base within the chamber. Additionally, the inner bottom section builds an inner support surface for the membrane. Therefore, by displacing the inner bottom section in the direction of the chamber, a passage can be produced in the membrane. However, the opening produced in the membrane is large and it is further difficult to control how this opening is shaped. Therefore, due to this, it can occur that the infusion product comes out of the infusion chamber during the preparation of the beverage.

SUMMARY OF THE INVENTION

It is an object of the invention to provide a capsule for preparing infusion beverages in which the opening of the closing layer can be achieved in a controlled and reliable manner. The purpose of the invention is achieved by a capsule for preparing infusion beverages of the type indicated at the beginning, characterized in that it further comprises: an inner wall arranged adjacent to said closing layer and crosswise to said longitudinal direction to divide said inner chamber into an infusion chamber and an extraction chamber, said inner wall comprising a plurality of second openings fluidly connecting said infusion chamber with said extraction chamber and receiving openings adapted to receive said perforation members, arranged adjacent to said bearing side of said closing layer, and said bearing side of said closing layer being arranged relative to said end wall and said inner wall such that, when said capsule is in said open position, said bearing side of said closing layer bears respectively against one of said inner wall or said end wall, in order for said perforation members to cooperate with said receiving openings and perforate said closing layer, said receiving openings being arranged correspondingly on one of said inner wall or said end wall.

In the invention, an infusion beverage refers to any type of beverage prepared from a hot or cold infusion fluid, and preferably water, mixed with an infusion product. The infusion product can be ground coffee, tea, "mate" infusion, or alternatively other soluble products, such as soluble coffee, cocoa, soup, milk, juices or the like.

The infusion fluid is usually water under pressure, and preferably hot water. Nevertheless, it is not ruled out that cold water or other fluids can also be used.

Referring again to the problem of the invention and differently to the capsules of the state of the art, in the capsule of the invention, the closing layer is arranged between the end and the inner walls. When the capsule moves from the closed position into the open position, the closing layer, short before arriving completely to the open position, is trapped between the perforation members and the surface on which the closing layer bears before being perforated by the perforation members. If the bearing surface is the inner wall, then, this wall is provided with the receiving openings, while the perforation members are arranged on the end wall facing the perforation side of the closing layer. In this position, the receiving openings and the perforation members are facing each other only separated by the closing layer. Therefore, when the perforation members exert a pressure on the perforation side of the closing layer, the closing layer is held tight at the borders of the receiving openings. Then, the closing layer breaks and the perforation members are introduced in the receiving openings in a guided, controlled and reliable manner. This avoids rough breakings of the closing layer, as it used to happen in the capsules of the state of the art.

In the opposite, if the bearing surface is the end wall, then this end wall includes the receiving openings, and the perforation members are arranged on the side of the inner wall facing the closing layer. This provides again for a solid support surface for the bearing side of the closing layer. Therefore, the perforation members work properly again to break the closing layer in a clean and controlled manner. Therefore, also in this case and compared to the capsules of the state of the art, the perforation of the closing layer is precise and controlled.

The invention further includes a number of preferred features that are the object of the dependent claims and the utility of which will be highlighted hereinafter in the detailed description of an embodiment of the invention.

In a preferred embodiment, said perforation members are arranged on said inner wall facing said perforation side of said closing layer and said receiving openings are arranged on said end wall. Since the inner wall is a rigid wall, a more secure opening is achieved.

Also in order to have a good tightening of the closing layer, short before the perforation of the closing layer takes place, said closing layer is connected to said deformation section. When the deformation section deforms, the closing layer is tightened accordingly to this deformation. Then, thanks to the closing layer being tensioned, it can easily be perforated and this provides for a fast and even a more reliable perforation of the closing layer. In an especially preferred embodiment, the bearing side of said closing layer is heat sealed on a sealing shoulder provided on the deformation section of the end wall.

In an alternative embodiment, said perforation members are arranged on said end wall facing said perforation side of said closing layer and said receiving openings are arranged on said inner wall. Since the inner wall is a rigid element, a more secure opening is obtained.

Also preferably, said perforation members are arranged on at least one of said deformation or central sections in order to have a longer stroke. The longer the stroke, the lesser the risk of the perforations members not to completely perforate the closing layer due to the capsule to tolerances.

In another embodiment, having the object of obtaining a higher rigidity of the containing body, said side wall and said inner wall are a single part and said end wall is a separate part connected to said side wall or said inner wall. Alternatively said side wall and said end wall are a single part and inner wall is a separate part connected to said side wall or said end wall.

The separate part of the previous paragraph, that is the corresponding end wall or the inner wall, can be connected to the rest of the containing body by any suitable method, such as heat sealing. Alternatively, the bonding could be made by gluing, ultrasound or the like.

In another preferred embodiment, looking for a flexible but at the same time robust configuration of the deformation section, said deformation section is made from a weakening in the wall thickness in combination with a reinforcing rip around the whole outer perimeter of said central section. Alternatively said deformation section is formed in the shape of a bellows.

Preferably, in order to avoid water leaking from the inner chamber, the deformation section is plastically deformable. Thanks to this, the perforation members seal the openings produced in the closing layer. Then, it is more difficult that the rest of infusion beverage contained in the infusion chamber comes out of the inner chamber.

In a preferred embodiment looking for an easier assembly of the capsule, said perforation members are regularly distributed.

Preferably, said perforation members are sharp cutting edges of the type of cones, pyramids, triangles or the like.

Another matter considered by the invention is a use of the capsule as hygienic as possible. To that end, preferably in the extraction area of the capsule, a duct projects out of the outer contour of the containing body, and more particularly from the outer contour of the end wall, far beyond said extraction chamber. This makes it easier to be able to move the outlet point of the beverage away from the body of the machine, such that the risk of the beverage coming into contact with the machine as it exits is reduced, and accordingly the working is more hygienic.

An object of another particularly preferred embodiment is to simplify the manufacture of the capsule. The main body of the capsule can therefore be manufactured by forming if it is manufactured with a sheet of aluminum, or by thermoforming or injection molding if it is manufactured with plastic.

The cover is preferably a sheet of composite material that can be punctured, and made of materials, such as aluminum, plastic or combinations thereof. Alternatively, the cover could be a disc made of a material that can be punctured, such as plastic.

The containing body is manufactured in a substantially rigid material, such as aluminum, or injected or thermoformed plastic. It can also have different geometries, such as a rotational symmetric body, in the form of a cylindrical, conical, frustroconical or similar body shape. The containing body can also have mirror symmetrical shapes, obtained from a mirror symmetrical cross section, such as regular polygons like a square, rectangle, pentagon, hexagon, heptagon, octagon or any number of sides, or other symmetrical cross-sections.

In an embodiment of the invention, said sheet-like closing layer arranged adjacent to said end wall is a sealing layer for sealingly closing said inner chamber from said first opening for extraction. Said sealing layer is preferably gas-tight.

Preferably, the material of the containing body, of the closing layer and the material of the cover are both barrier property materials to prevent infusion product degradation in order to avoid additional packaging measures. In the invention, a barrier property material refers to a material that does not let oxygen through the capsule walls or at least that lets it through at very low levels. In a particularly preferred manner, barrier materials according to the invention are those having an oxygen transmission rate (OTR) less than or equal to 0.1 $cm^3$/container/day. In the measurement, the oxygen transmission rate of the container refers to a closed capsule with the cover. As a result, the infusion product is preserved better and for a longer time inside the inner chamber.

Suitable materials for providing a barrier property are, for example, high density polyethylene (HDPE), aluminum, materials made up of a combination of different layers of polymers and metals, cellulose or others. These materials, such as aluminum or polyethylene (PE), prevent oxygen from coming into contact with the primary product before the capsule is opened to start beverage preparation, and therefore prevent oxidation thereof.

Removing oxygen from inside the inner chamber is also preferred before closing the capsule to complete packaging. The inner chamber containing the infusion product can be filled with a protective atmosphere, such as nitrogen. Then, the capsule is closed in an air-tight manner, preventing the infusion product from being exposed to an atmosphere that could degrade it.

Alternatively, if the material of the containing body, the sealing layer and the cover are not a barrier material, the capsule could be packed in a wrapper having a barrier property, duly packaged in the absence of oxygen. For example, a sheet made by laminating a sheet of plastic and a sheet of aluminum could be used.

Likewise, the invention also includes other features of detail illustrated in the detailed description of an embodiment of the invention and in the accompanying figures.

BRIEF DESCRIPTION OF THE DRAWINGS

Further advantages and features of the invention will become apparent from the following description, in which, without any limiting character, preferred embodiments of the invention are disclosed, with reference to the accompanying drawings in which.

DETAILED DESCRIPTION OF EMBODIMENTS OF THE INVENTION

Figure 1:
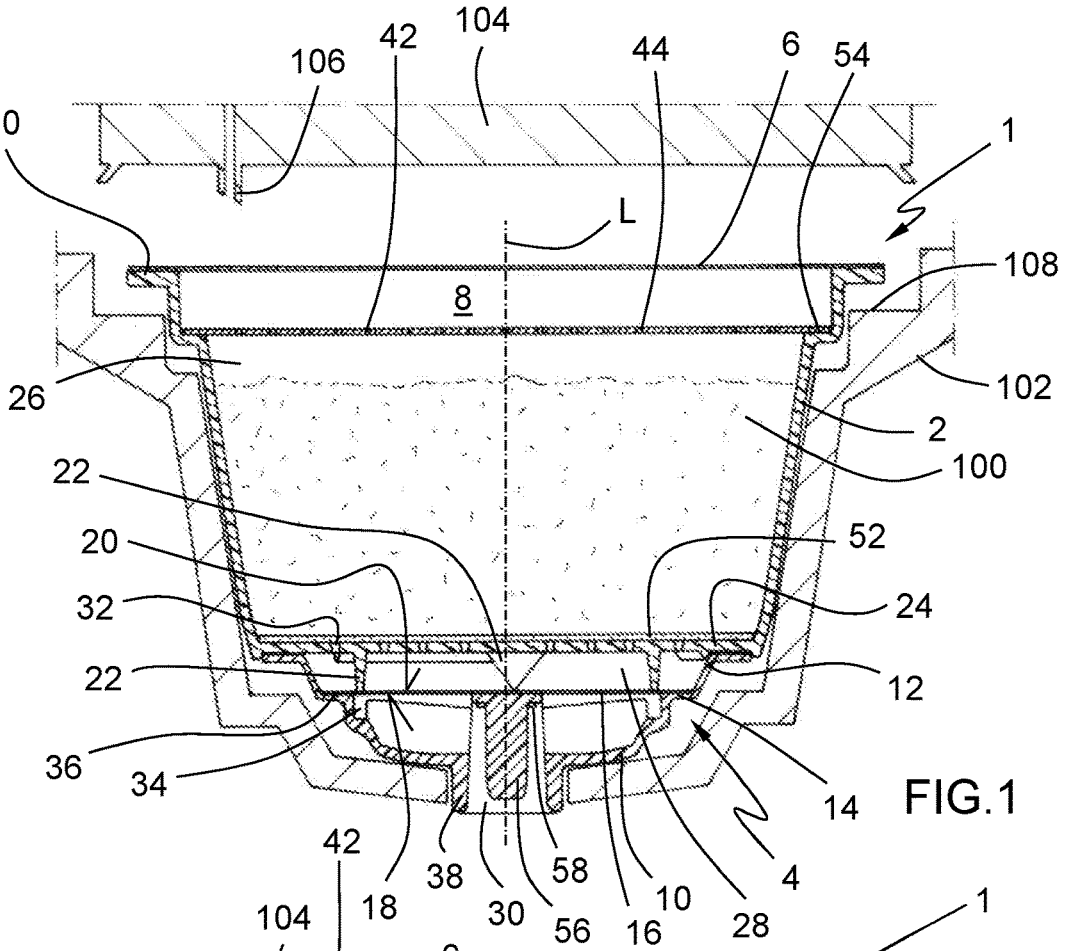
FIG. 1 shows a longitudinal section view of a first embodiment of a capsule according to the invention, with the capsule in a closed position and placed inside a machine for preparing infusions with the machine open.

FIGS. 1 to 5 show a first embodiment of the capsule 1 for preparing infusion beverages according to the invention.

The capsule 1 comprises a containing body and a cover 6.

The containing body defines a longitudinal direction L with a side wall 2 and an end wall 4.

The cover is preferably made up of a sheet-like closing layer of composite material, such as aluminium and polyethylene.

The containing body and the cover 6 are connected to each other at the upper end of the side wall 2 to form the limits of the inner chamber 8 for containing the infusion product 100.

The end wall 4 of the capsule 1 is divided in a central section 10, an outer section 12 arranged around said central section 10, and a deformation section 14 connecting said central and said outer sections 10, 12.

The central and outer sections 10, 12 are movable relative to each other via the deformation section 14. As it is apparent from FIGS. 3 and 4, the deformation section 14 of this embodiment is made from a weakening 46 in the wall thickness combined with a radius around the whole outer perimeter of the central section 10. Therefore, the capsule 1 can move between two end positions which are: a closed position, in which the central section 10 is remote from the inner chamber 8 and no infusion beverage can be extracted, and an open position, in which the central section 10 is near to the inner chamber 8 and the infusion beverage can be extracted from the capsule by circulating the infusion fluid. It is especially preferred that the deformation section 14 is plastically deformable. This reduces leakages in the capsule and eventually splashes when it is removed from the capsule holder after its use.

The capsule 1 is further provided with a first opening 30 for extracting the infusion beverage. This first opening 30 can be either opened or closed, depending on the embodiment. Additionally, in this embodiment, the cross section first opening 30 is further reduced with a stream pacification member 56 arranged to slow down the stream of infusion beverage coming out of the extraction chamber 28 through the outlets 58.

The capsule 1 comprises also a sheet-like closing layer 16 arranged adjacent to the end wall 4 for closing said inner chamber 8 from said first opening 30 for extraction. As it is apparent from detail FIGS. 3 and 4, the closing layer 16 has a bearing side 18 directed to bear against a bearing surface, and a perforation side 20 on which the perforation of the closing layer 16 starts. More particularly, the sheet-like closing layer 16 arranged adjacent to said end wall 4 is a sealing layer for sealingly closing the inner chamber 8 from the first opening 30 for extraction.

The capsule 1 also has perforation members 22, arranged in said inner chamber 8 adjacent to the perforation side 20 of the closing layer 16. In this particular embodiment, the perforation members 22 are arranged on the inner wall 24, and more particularly, are injection moulded on its face, facing the perforation side 20 of the closing layer 16. The perforation members 22 are directed to perforate the closing layer 16 when the capsule 1 is in the open position.

In order to provide a capsule 1 in which the opening of the closing layer 16 can be achieved in a controlled and reliable manner, the capsule 1 comprises an inner wall 24 arranged adjacent to the closing layer 16 and crosswise to said longitudinal direction L. This inner wall 24 divides the inner chamber 8 into an infusion chamber 26 and an extraction chamber 28. The side wall 2 and said inner wall 24 are a single part.

Furthermore, the end wall 4 is a separate part connected to said side wall 2 and said inner wall 24. Especially preferred, the containing body is made of plastics. Therefore, the end wall 4 and the inner wall 24 can be connected to each other by heat sealing. Alternatively, the bonding could be made by gluing, ultrasound or the like.

In order for the infusion beverage to be extracted from the infusion chamber, the inner wall 24 comprises a plurality of second openings 32 fluidly connecting the infusion chamber 26 with the extraction chamber 28.

The capsule 1 is also provided with receiving openings 34 adapted to receive the perforation members 22 when the capsule 1 is on open position. These openings are located at the bearing side 18 of the closing layer 16. Furthermore, in this particular embodiment, these receiving openings 34 are arranged on the so-called bearing surface of the end wall 4.

Finally, as it is apparent from the figures, the bearing side 18 of the closing layer 16 is arranged facing the end wall 4 and connected to the deformation section 14. More particularly, the bearing side 18 is preferably heat-sealed on a sealing shoulder 36 provided on the deformation section 14 of the end wall 4.

Therefore, when the capsule 1 is in the open position, the bearing side 18 of the closing layer 16 lays in this case on the end wall 4, and thus bears against the end wall 4. At this point the perforation members 22 cooperate with the receiving openings 34 provided on the end wall 4 and perforate the closing layer 16.

Now, it will be explained how the capsule 1 of the invention is operated, based on this first embodiment.

Initially, the capsule 1, which is in the closed position, is introduced in the machine for preparing infusion beverages. For the sake of simplicity, in FIGS. 1 and 2, only a schematic structure of the capsule holder of the machine is shown.

The capsule 1 is inserted in a fixed part 102 of the capsule holder until the duct 38 delimiting the first opening 30 projects through the opening at the lower part of the fixed part 102 and the capsule 1 is supported, for example, at the end wall 4. At this point, the flange like rim 40 of the capsule 1 does not bear against the shoulder 108 of the fixed part 102. It must also be pointed out that, even if the capsule holder is depicted in the vertical direction, in the most general concept of the invention, the capsule 1 has no particular orientation of operation. Therefore, in the most general concept of the invention, the capsule 1 can work in any orientation, such as vertically, horizontally or slightly inclined depending on the operation way of the machine.

Once the capsule 1 is inside the capsule holder, a moving part 104 of the capsule holder moves the cover 6 to compress the capsule 1 inside the capsule holder, making a downward linear movement in the longitudinal direction L. Alternatively, the moving part 104 could make a pivoting movement. It would also be possible for the fixed and moving parts 102, 104 to be interchanged, i.e., for the moving part 104 to be stationary and for the fixed part 102 to be the part that moves up to abut with the moving part 104. First of all, the punch-like injector 106 punctures the cover 6, and finally the moving part 104 contacts the cover 6. As downward movement continues, the central section abuts against the fixed part 102, and thus the deformation section 14 deforms upwards to allow the containing body to be compressed when it moves downwards.

This downwards movement causes that the perforation members 22 break the closing layer 16 and are inserted in the receiving openings 34 of the end wall 4, thus reaching the open position of the capsule 1.

When the moving part 104 has reached the end of its travel, the capsule 1 is trapped in a leak-tight manner inside the capsule holder. It is worth commenting that the capsule 1 is depicted in the drawings with a certain play inside the capsule holder to make the invention easier to understand, but in practice the capsule 1 would tightly be compressed between the fixed and moving parts 102, 104 of the capsule holder.

The external compressive force is usually exerted by the capsule holder of the machine when it is closed before starting the introduction of fluid. Nevertheless, the compressive force could also be generated by the user manually before introducing the capsule 1 in the machine is not ruled out by compressing the end wall 4 against the inside of the containing body.

Figure 2:
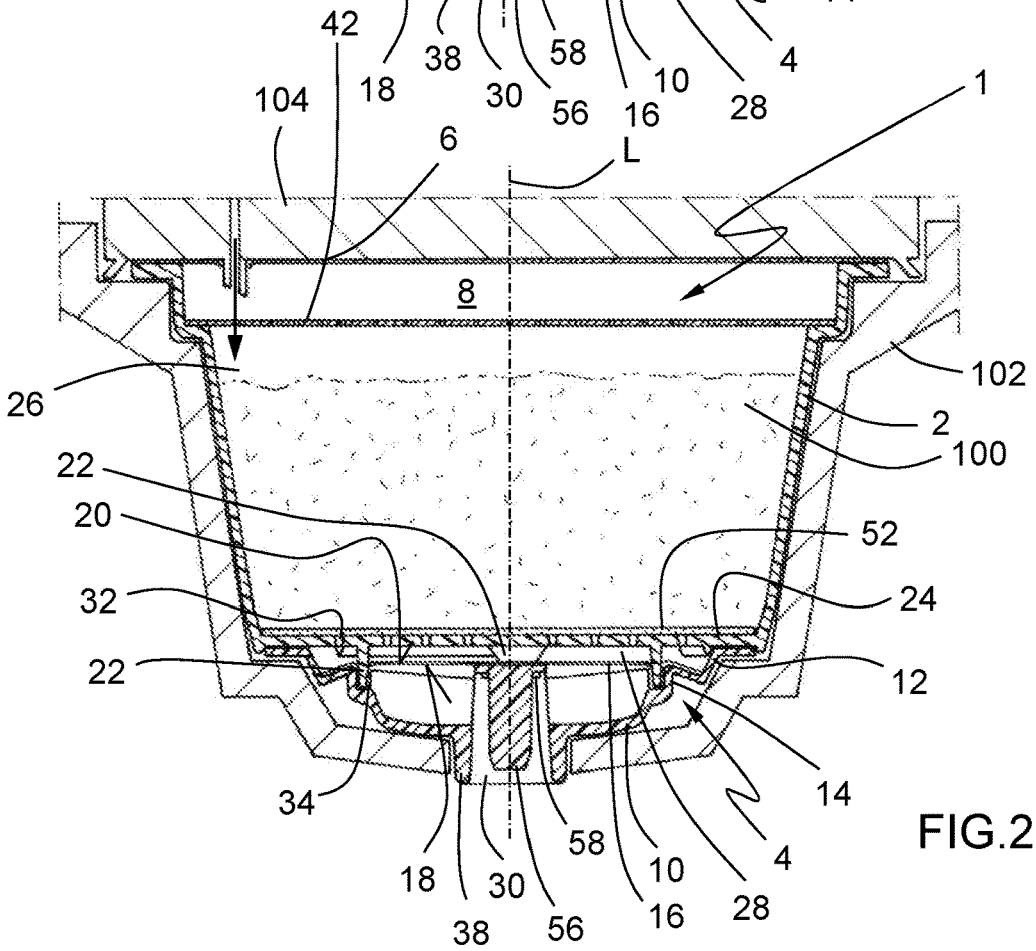
FIG. 2 shows a longitudinal section view of the capsule of FIG. 1, with the capsule in an open position, with the machine closed.
Figure 3:
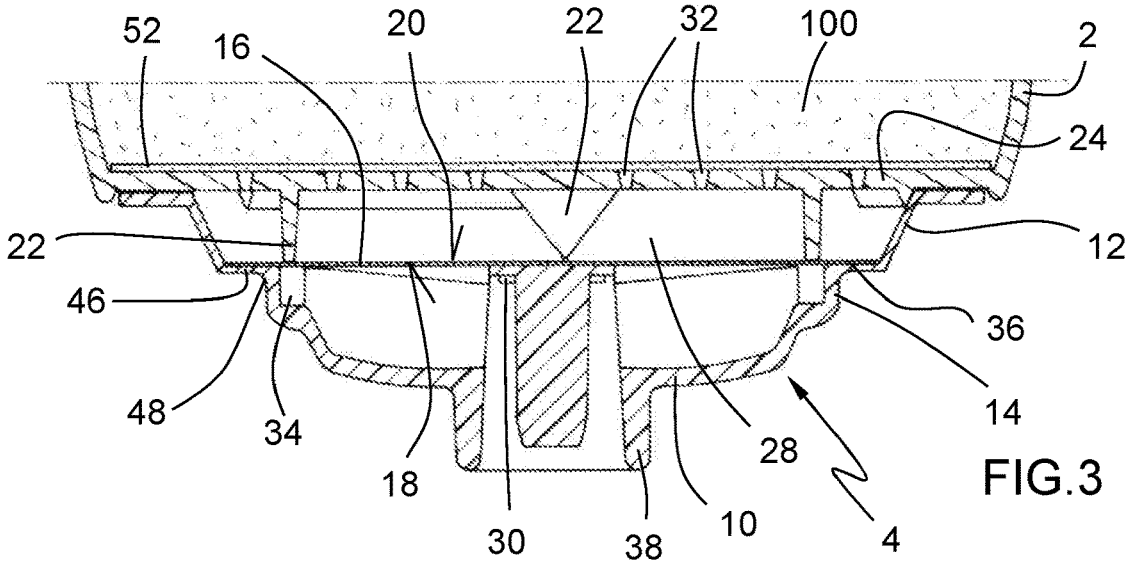
FIG. 3 shows a detail view of the extraction side of the capsule of FIG. 1, in the closed position of the capsule.
Figure 4:
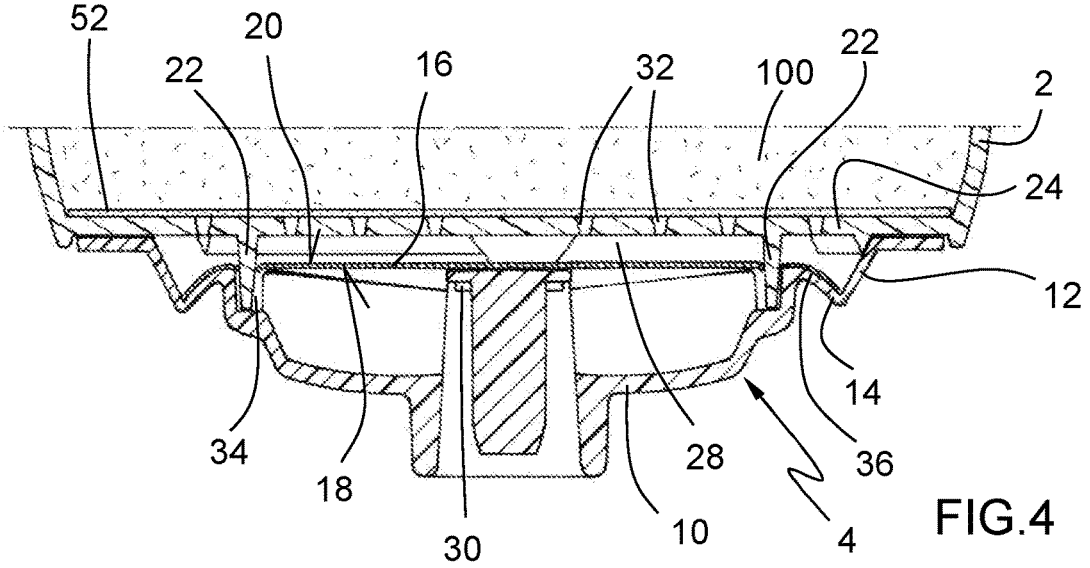
FIG. 4 shows a detail view of the extraction side of the capsule of FIG. 1, in the open position of the capsule.
Figure 5:
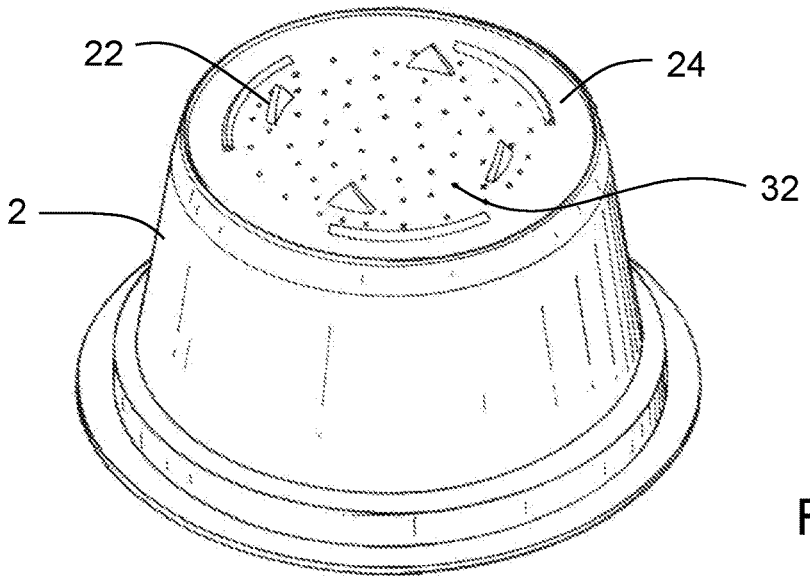
FIG. 5 shows a lower perspective view of the containing body of the capsule with the corresponding puncturing means thereof.

Once this open position has been reached, the injection of fluid into the infusion chamber 26 can start, as indicated with the arrow drawn in the injector 106 of FIG. 2. In this case, the injection takes place in an off-centered manner from above, but it could be carried out from other points of the capsule 1. For example, the injection could be made from a central upper area or also side area or even lower area.

At the upper part of the infusion chamber 26, the capsule 1 is provided with a sheet-like fluid distribution layer 42 of a material such like cellulose or a plastic film with a plurality of perforations 44 the allow fluid to pass through. This distribution layer 42 provides for the fluid to be evenly distributed throughout the whole area of the infusion chamber 26, when it penetrates the infusion chamber 26, such that the infusion product 100 is wetted in a more uniform, slow and progressive way. This distribution layer 42 is heat sealed on a shoulder 54 formed at the upper end of the side wall 2 of the containing body.

When the fluid flows through the fluid distribution layer 42, then it crosses the whole content of infusion product 100, while mixing with it. Afterwards, the infusion beverage can leave the infusion chamber 26 through the second openings 32, into the extraction chamber 28. In order to prevent grains of infusion product 100 from reaching the extraction chamber 28 during the beverage preparation, in this embodiment, a filtering layer 52 is arranged on the side of the inner wall 24 facing the infusion chamber 26. This filtering layer 52 is a layer of cellulose. Alternatively, it can be a sheet-like plastic layer having through openings that are not aligned with the second openings 32.

In a specially preferred manner the deformation section 14 is plastically deformable, such that when the capsule 1 is removed from the capsule holder, the perforation members 22 seal the openings formed in the closing layer, avoiding the user to get stained.

Other embodiments of the capsule 1 according to the invention are shown below which share most of the features described in the preceding paragraphs. Accordingly, only the elements differentiating the embodiments from one another will be described hereinafter, whereas reference to the description of the first embodiment is made with respect to the elements they have in common.

Figure 6:
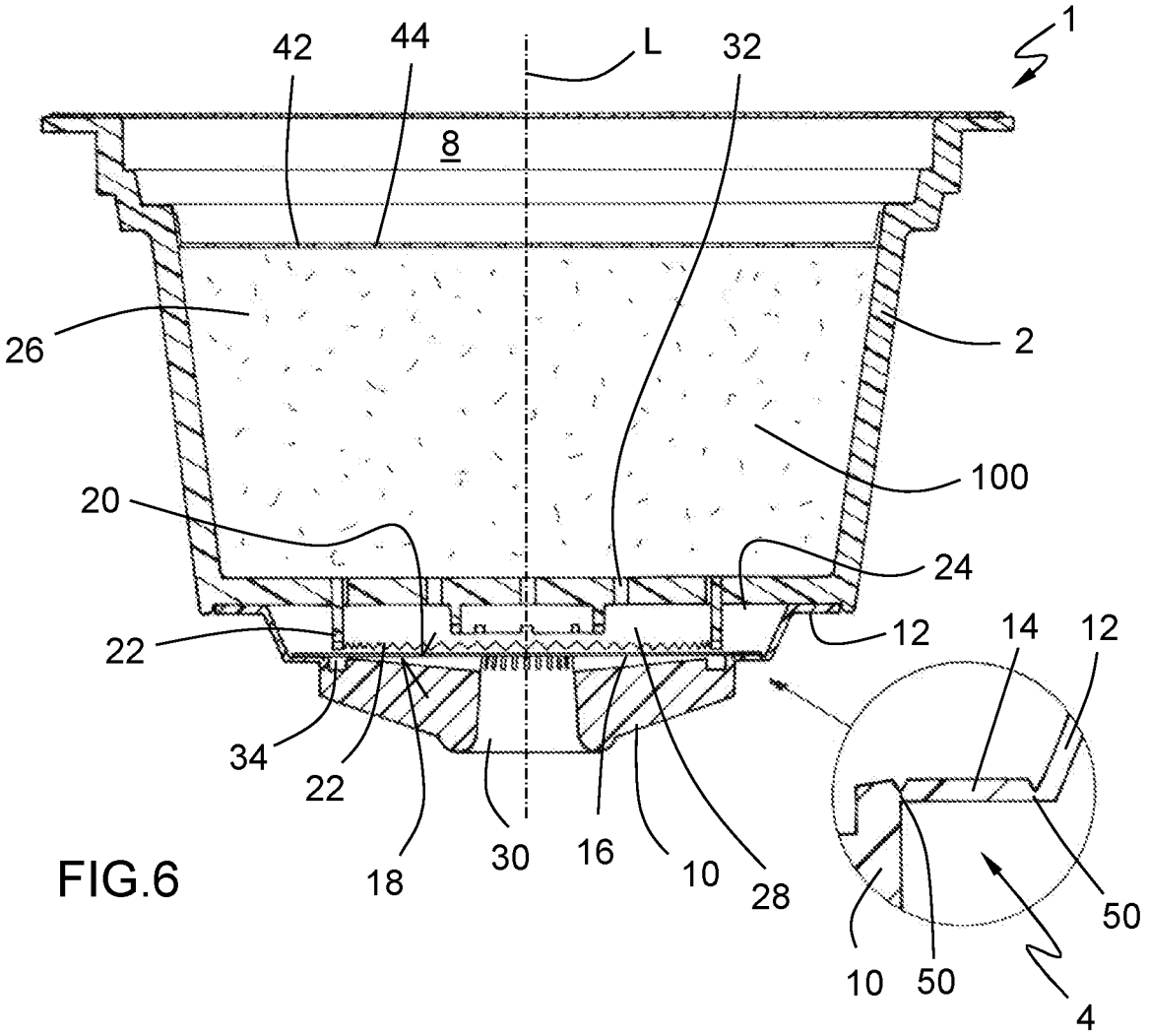
FIG. 6 shows a longitudinal section view of a second embodiment of a capsule according to the invention, with the capsule in the closed position.

The embodiment of FIG. 6 differs from the one of FIGS. 1 to 5 firstly in that the deformation section 14 is made from a crown section, connected at its inner and outer perimeter edges respectively to the central section 10 and the outer section 12 by means of bending lines 50. These bending lines 50 can be seen in the detailed view of FIG. 6.

Furthermore, in this case, the perforation members 22 are a toothed ring configured to be inserted into the receiving openings 34 at the central section 10, which in this case are an annular groove.

Also in this case, the capsule 1 is free of a filtering layer arranged on the side of the inner wall 24 facing the infusion chamber 26. In the figure, the second openings 32 have been depicted relatively large for the sake of clarity. However, when the capsule 1 has no filtering layer, then the size of the openings is smaller than the size the theoretical diameter of 80 to 90% of the grains of the infusion product.

Finally, in this case, also the distribution layer 42 is joined, e.g. by heat sealing or gluing, to the inner side of the side wall 2 of the containing body. This provides for better adaption to the amount of infusion product 100 contained in the infusion chamber 26.

Figure 7:
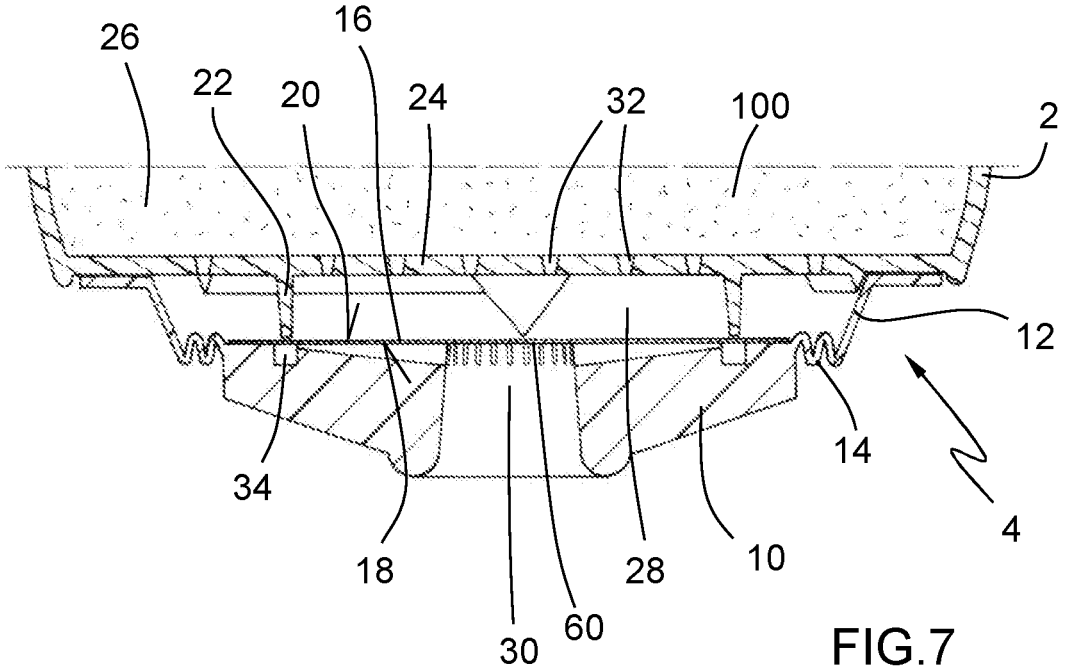
FIG. 7 shows a detail view of the extraction side of a third embodiment of the capsule, in the closed position of the capsule.

The third embodiment of FIG. 7 is based on the embodiment of FIGS. 1 to 5. However, in this case, the deformation section 14 is formed in the shape of a bellows. The undulated shape of the bellows provides for the deformation of this deformation section 14 thus allowing the change of the position of the capsule 1 between the closed and the open positions.

This embodiment is also different from the one of FIGS. 1 to 5 in that the first opening 30 is not provided with a stream pacification member 56 and the capsule is free of a filtering layer 52.

Finally, in this case, the closing layer 16 is not connected to the deformation section 14, but to the outer perimeter and to the central disc 60 of the central section 10.

Figure 8:
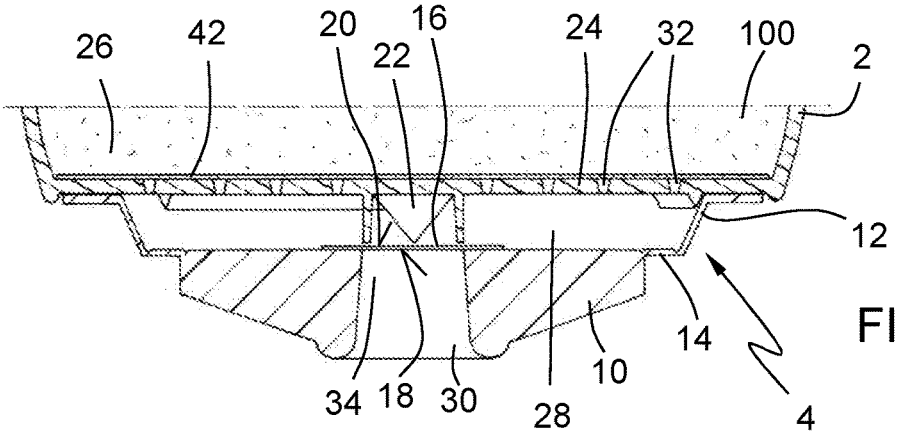
FIG. 8 shows a detail view of the extraction side of a fourth embodiment, in the closed position of the capsule.
Figure 9:
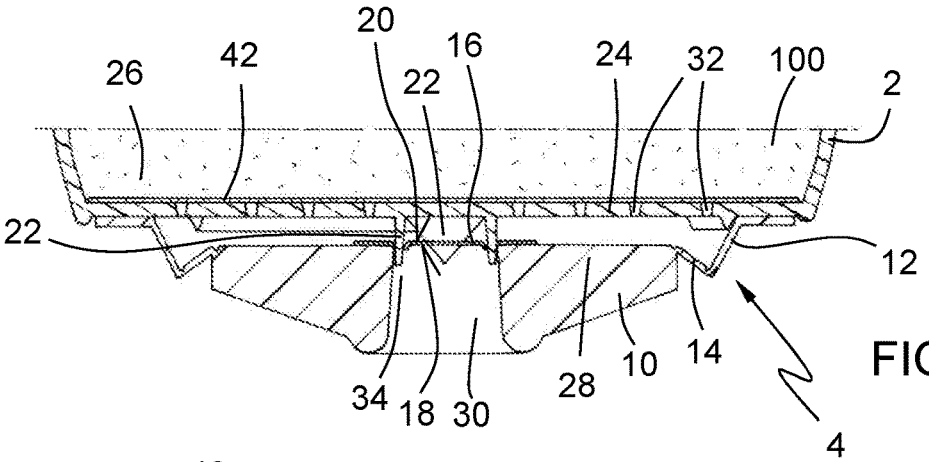
FIG. 9 shows a detail view of the extraction side of the capsule of FIG. 8, in the open position of the capsule.

Now referring to the fourth embodiment of FIGS. 8 and 9, it must be pointed out that the deformation section 14 is the same as the embodiment of FIG. 6. Therefore, no further details need to be introduced. However, in this case, the closing layer 16 is not connected to the deformation section 14, but to the central section 10, e.g. by heat sealing.

Additionally, in this embodiment, the perforation members 22 are also four evenly distributed triangle shaped teeth. However, in this case, the first opening 30 and the receiving openings 34 are the same opening, thus the perforation members 22 in the open position of the capsule 1 are inserted in this central receiving opening 34.

Figure 10:
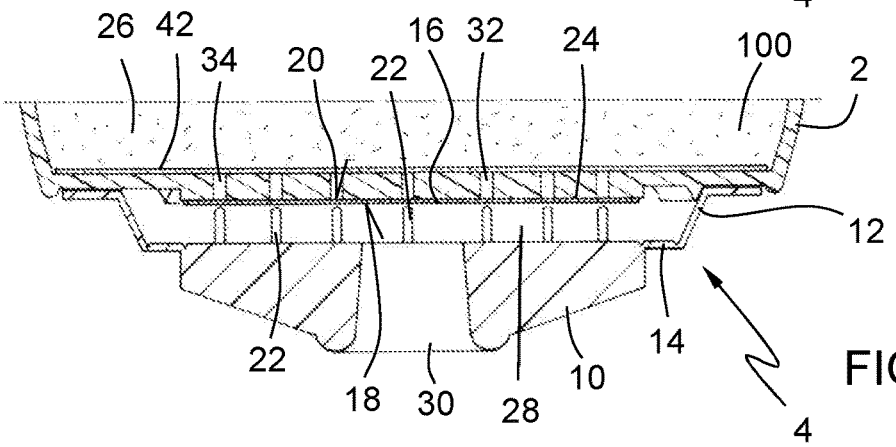
FIG. 10 shows a detail view of the extraction side of a fifth embodiment, in the closed position of the capsule.
Figure 11:
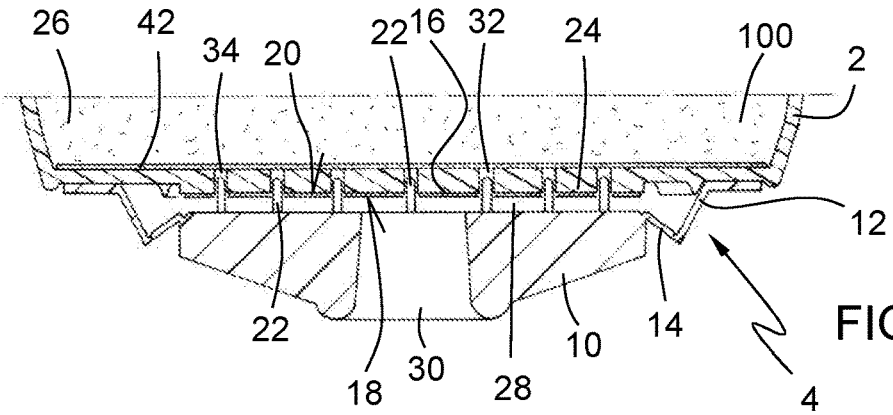
FIG. 11 shows a detail view of the extraction side of the capsule of FIG. 10, in the open position of the capsule.

Finally, the embodiment of FIGS. 10 and 11 is completely different to the previous embodiments in relation to the position of the perforation members.

In this case, the capsule 1 also comprises a containing body and a cover (not shown).

The containing body has also an end wall 4 having: a central section 10, an outer section 12 arranged around said central section 10, and a deformation section 14 connecting the central and the outer sections 10, 12. This, as in the previous examples, provides the movement of the capsule 1 between the closed and the open positions previously described.

Also in this case, the first opening 30 is provided on the central section 10.

The capsule 1 further comprises the sheet-like closing layer 16 between the end wall 4 and the inner wall 24 for closing the inner chamber 8 from the first opening 30.

The closing layer 16 has a bearing side 18 and a perforation side 20. More particularly, the closing layer 16 is supported at the bearing side 18 on the side of the inner wall 24 facing the extraction chamber 28.

Now, differently to the previous examples, the perforation members 22 are arranged on the end wall 4 facing the perforation side 20 of said closing layer 16 to perforate the closing layer 16 from the perforation side 20, when the capsule 1 is in the open position and the receiving openings 34 are arranged on the inner wall 24. Eventually, the perforation members 22 could also be formed on the deformation section 14.

Also in this case, in order for the perforation members 22 to properly break the closing layer 16, the inner wall 24 comprises a plurality of receiving openings 34 matching with the second openings 32 directed to fluidly connect the infusion chamber 26 with the extraction chamber 28.

As it is apparent from the figures, the bearing side 18 of the closing layer 16 is arranged relative to the inner wall 24 such that, when the capsule 1 is in the open position, the bearing side 18 of the closing layer 16 bears against the inner wall 24. Thanks to this, the perforation members 22 to cooperate with the receiving openings 34 arranged on the inner wall 24 and perforate the closing layer 16 in a controlled and reliable manner.

The invention claimed is:

1. A capsule for preparing infusion beverages comprising:
- containing body with a side wall and an end wall, said containing body defining a longitudinal direction (L);
- a cover;
  - said containing body and said cover being connected to each other at said side wall to form an inner chamber for containing an infusion product,
  - said end wall having,
    - a central section,
    - an outer section arranged around said central section,
    - a deformation section connecting said central and said outer sections such that said central and said outer sections are movable relative to each other via said deformation section for moving said capsule between,
      - a closed position, in which said central section is remote from said inner chamber, and
      - an open position, in which said central section is closer to said inner chamber than when in the closed position, and
    - a first opening for extracting said infusion beverage;
- a closing layer in the form of a sheet arranged adjacent to said end wall for closing said inner chamber from said first opening for extraction, said closing layer having a bearing side and a perforation side;

perforation members arranged in said inner chamber adjacent to said perforation side of said closing layer to perforate said closing layer when said capsule is in said open position;

an inner wall arranged adjacent to said closing layer and crosswise to said longitudinal direction (L) to divide said inner chamber into an infusion chamber and an extraction chamber, said inner wall including a plurality of second openings fluidly connecting said infusion chamber with said extraction chamber; and receiving openings to receive said perforation members, arranged adjacent to said bearing side of said closing layer, said bearing side of said closing layer being arranged relative to said end wall and said inner wall such that, when said capsule is in said open position, said bearing side of said closing layer bears respectively against one of said inner wall or said end wall, in order for said perforation members to cooperate with said receiving openings and perforate said closing layer, said receiving openings being correspondingly arranged on one of said inner wall or said end wall.

2. The capsule according to claim 1, wherein said perforation members are arranged on said inner wall facing said perforation side of said closing layer and said receiving openings are arranged on said end wall.

3. The capsule according to claim 2, wherein said closing layer is connected to said deformation section.

4. The capsule according to claim 3, wherein the bearing side of said closing layer is connected to a sealing shoulder provided on the deformation section of said end wall.

5. The capsule according to claim 1, wherein said perforation members are arranged on said end wall facing said perforation side of said closing layer and said receiving openings are arranged on said inner wall.

6. The capsule according to claim 5, wherein said perforation members are arranged on at least one of said deformation or central sections.

7. The capsule according to claim 1, wherein said side wall and said inner wall are a single part and in that said end wall is a separate part connected to said side wall or said inner wall.

8. The capsule according to claim 1, wherein said deformation section is made from a weakening in a wall thickness in combination with a reinforcing rip around a whole outer perimeter of said central section.

9. The capsule according to claim 1, wherein the deformation section is plastically deformable.

10. The capsule according to claim 1, wherein said closing layer arranged adjacent to said end wall is a sealing layer for sealingly closing said inner chamber from said first opening for extraction.

* * * * *